US009044660B2

(12) United States Patent
Selfridge

(10) Patent No.: US 9,044,660 B2
(45) Date of Patent: Jun. 2, 2015

(54) GOLF CLUB WITH CUT-OUT CAVITY

(76) Inventor: Brian K. Selfridge, Mt. Laurel, NJ (US)

( * ) Notice: Subject to any disclaimer, the term of this patent is extended or adjusted under 35 U.S.C. 154(b) by 544 days.

(21) Appl. No.: 13/338,879

(22) Filed: Dec. 28, 2011

(65) Prior Publication Data

US 2013/0172100 A1 Jul. 4, 2013

(51) Int. Cl.
*A63B 53/04* (2006.01)
*A63B 69/36* (2006.01)

(52) U.S. Cl.
CPC ..... *A63B 69/3632* (2013.01); *A63B 53/0466* (2013.01); *A63B 2053/0433* (2013.01); *A63B 2053/0437* (2013.01)

(58) Field of Classification Search
CPC .. A63B 53/007; A63B 53/04; A63B 53/0466; A63B 2053/04; A63B 2053/0408; A63B 2053/0412; A63B 2053/0437
USPC ..... 473/219, 228, 324–350
See application file for complete search history.

(56) References Cited

U.S. PATENT DOCUMENTS

| | | | | | |
|---|---|---|---|---|---|
| 1,541,126 | A | | 6/1925 | Dunn | |
| 3,166,320 | A | * | 1/1965 | Onions | 473/314 |
| 3,779,398 | A | | 12/1973 | Hunter | |
| D239,964 | S | | 5/1976 | Wilson | |
| D240,948 | S | | 8/1976 | Redouty | |
| 3,976,299 | A | * | 8/1976 | Lawrence et al. | 473/327 |
| D256,262 | S | | 8/1980 | Benson | |
| 4,431,192 | A | * | 2/1984 | Stuff, Jr. | 473/327 |
| 4,444,392 | A | * | 4/1984 | Duclos | 473/290 |
| D275,412 | S | * | 9/1984 | Simmons | D21/752 |
| D275,590 | S | * | 9/1984 | Duclos | D21/733 |
| 4,653,756 | A | * | 3/1987 | Sato | 473/327 |
| D306,629 | S | * | 3/1990 | Shearer | D21/743 |
| D326,130 | S | * | 5/1992 | Chorne | D21/733 |
| 5,186,465 | A | * | 2/1993 | Chorne | 473/350 |
| 5,203,565 | A | * | 4/1993 | Murray et al. | 473/242 |
| 5,429,354 | A | * | 7/1995 | Long et al. | 473/342 |
| 5,435,558 | A | * | 7/1995 | Iriarte | 473/327 |
| D363,100 | S | * | 10/1995 | Long et al. | D21/733 |
| D368,751 | S | | 4/1996 | Rife | |
| 5,518,242 | A | * | 5/1996 | Mahaffey et al. | 473/342 |
| D394,887 | S | | 6/1998 | Bottema | |
| 5,785,609 | A | * | 7/1998 | Sheets et al. | 473/327 |
| 5,961,398 | A | * | 10/1999 | McMillan | 473/327 |
| D418,885 | S | | 1/2000 | Wanchena | |
| D447,201 | S | * | 8/2001 | Boyd | D21/752 |
| D470,553 | S | * | 2/2003 | Helmstetter et al. | D21/733 |
| D484,937 | S | * | 1/2004 | Madore et al. | D21/759 |
| 6,846,246 | B2 | | 1/2005 | Asplund et al. | |
| D502,973 | S | * | 3/2005 | Gillig | D21/736 |
| D503,443 | S | * | 3/2005 | Gillig | D21/733 |
| D506,518 | S | * | 6/2005 | Jones | D21/736 |
| D509,869 | S | * | 9/2005 | Mahaffey | D21/752 |

(Continued)

FOREIGN PATENT DOCUMENTS

| | | | | |
|---|---|---|---|---|
| JP | 02013481 A | * | 1/1990 | A63B 53/04 |
| JP | 08141118 A | * | 6/1996 | A63B 53/04 |
| JP | 2009279373 A | * | 12/2009 | |

*Primary Examiner* — Alvin Hunter
(74) *Attorney, Agent, or Firm* — Fox Rothschild LLP

(57) ABSTRACT

A golf club having a club head with a cut-out cavity which is configured to accept the footwear of a golfing instructor, caddy, playing partner, or other individual available to assist the golfer. The club head has a flat bottom and a downwardly and rearwardly sloping top surface. It is aerodynamically designed, both as to the outer shape of the club head and the configuration of the cavity, to increase driving distances.

11 Claims, 8 Drawing Sheets

(56) References Cited

U.S. PATENT DOCUMENTS

| | | | | | |
|---|---|---|---|---|---|
| D524,890 | S | | 7/2006 | Foster et al. | |
| D532,853 | S | * | 11/2006 | Oldknow | D21/752 |
| D532,855 | S | * | 11/2006 | Madore et al. | D21/752 |
| D543,600 | S | | 5/2007 | Oldknow | |
| 7,255,653 | B2 | * | 8/2007 | Saso | 473/345 |
| 7,297,071 | B2 | * | 11/2007 | Hyman | 473/305 |
| D568,955 | S | * | 5/2008 | Oldknow et al. | D21/759 |
| 7,488,261 | B2 | | 2/2009 | Cackett et al. | |
| 7,713,138 | B2 | * | 5/2010 | Sato et al. | 473/327 |
| 7,753,809 | B2 | * | 7/2010 | Cackett et al. | 473/345 |
| 7,980,964 | B2 | | 7/2011 | Soracco | |
| 8,162,775 | B2 | * | 4/2012 | Tavares et al. | 473/327 |
| 8,628,433 | B2 | * | 1/2014 | Stites et al. | 473/327 |
| 8,636,610 | B2 | * | 1/2014 | Golden et al. | 473/349 |
| 8,702,531 | B2 | * | 4/2014 | Boyd et al. | 473/305 |
| 2003/0195055 | A1 | * | 10/2003 | Helmstetter et al. | 473/290 |
| 2004/0116200 | A1 | * | 6/2004 | Helmstetter et al. | 473/291 |
| 2004/0138002 | A1 | * | 7/2004 | Murray | 473/327 |
| 2005/0032584 | A1 | * | 2/2005 | Van Nimwegen | 473/327 |
| 2006/0240906 | A1 | * | 10/2006 | Chen | 473/327 |
| 2014/0066224 | A1 | * | 3/2014 | Albertsen et al. | 473/327 |

* cited by examiner

GOLF CLUB WITH CUT-OUT CAVITY

FIELD OF THE INVENTION

The present invention relates generally to the sport of golf and specifically to a golf club with a unique club head.

BACKGROUND OF THE INVENTION

The ultimate goal of the golfer is hit the golf ball in a pre-selected, pre-aimed direction and a desired distance. In order to accomplish this, all parts of the golfer's body must be properly aligned. Not only must the golfer ensure that his stance relative to the ball is correct for optimum accuracy, alignment, etc., but the head, shoulders, arms, hands, and lower body need to be correctly positioned, in order to obtain the best possible golf shot.

There are a myriad number of training aids, devices, and teaching equipment designed to educate the golfer in the basic and advance techniques of the sport, all having varying degrees of success. Yet the best results usually come from one on one, personal instruction from a golf pro or other competent teacher who provides hands on lessons. Such teaching sessions routinely place the golfing instructor across from the golfer, commenting on stance and positioning, while the golfer holds the club and aligns his body and the club accordingly. Oft times the instructor will personally reposition the golfer and his club, consistent with the advice being given.

While this common teaching method is most helpful, it is usually difficult for the instructor to verbally instruct and properly position the golfer, while at the same time ensuring that the club the golfer is holding is stationary and maintained at the correct shaft angle, with the club face properly aimed at the target. When an instructor attempts to explain proper golfing practices and techniques while physically manipulating the golfer in position, the club being held by the golfer will have a tendency to wander and move from its set, pre-aimed placement, thus impeding the progress of the teaching session. There is currently no equipment or teaching process which allows the golf instructor to control the placement of the golf club, ensuring it is maintained in proper alignment, while simultaneously providing verbal and physical instruction.

Positioning a golf club, generally, such that it is properly aligned and aimed at the desired target, prior to swinging the club, is key to an acceptable golf shot. However, even many good golfers will slice, hook, or misdirect a golf shot because, prior to taking the shot, the club is being held at the wrong shaft angle or the club face is not correctly aligned. A golf club having a club head which simply addresses and corrects this problem, i.e. serves to ensure that the club is properly placed and maintained in position prior to the golfer taking a swing, would constitute a major improvement. A golf club having a club head which, at the same time serves to increase the length of drives would be an added benefit.

SUMMARY OF THE INVENTION

It is thus the object of the present invention to provide a golf club and golf club teaching and club positioning methods which overcome the disadvantages and limitations of prior golfing equipment and teaching practices.

This object is accomplished by the present invention, a golf club having a club head with a cut-out cavity configured to accept the footwear of a golfing instructor, caddy, playing partner, or other individual available to assist the golfer. The club head has a flat bottom. Once it is placed flush on the ground surface and the club is positioned at the proper shaft angle with the club face aligned towards the target, the individual assisting the golfer places his foot into the cavity of the club head to maintain the club in this position. The golfer then literally "steps into the golf shot" by accepting the pre-aligned club, grabs hold of the club's handle, and positions himself with the club. When the assister's foot is removed from the cavity, the golfer is free to swing the club, confident it is in the proper pre-shot position. The golf club of the present invention can not only be advantageously used while playing a round of golf, but it also is an integral component in the teaching process. The golfing instructor can maintain control of the club with his foot within the cavity, thus keeping the club aimed and maintaining it at the correct shaft angle, while, at the same time, verbally instructing and physically manipulating and positioning the body, hands, and feet of the golfer holding the club. The club head itself is aerodynamically designed, as to both the outer shape of the club head and the configuration of the cavity, to increase driving distances.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 5:
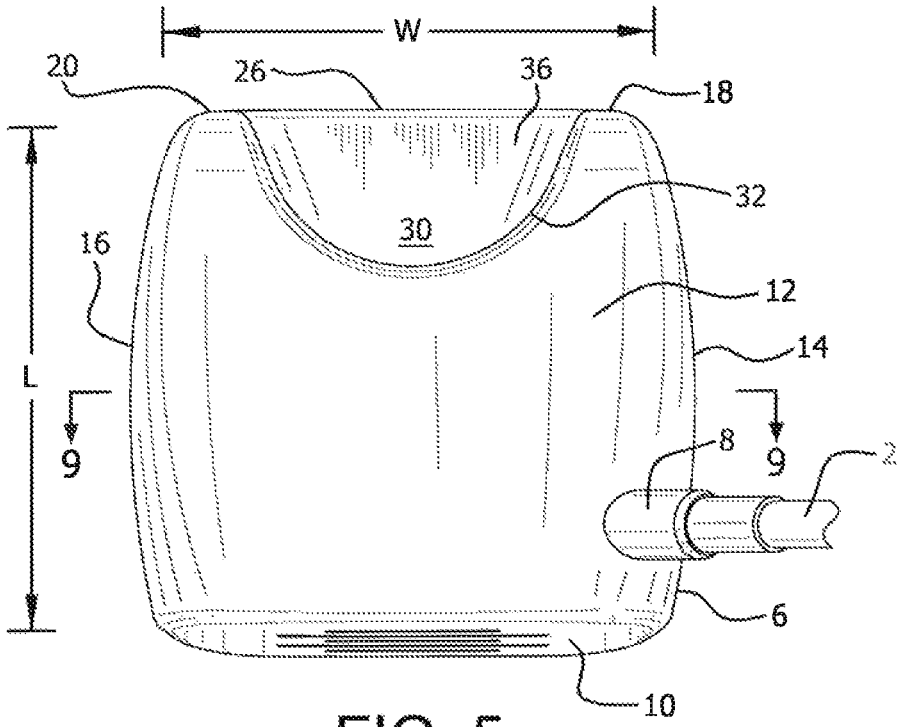
FIG. 5 is a top view of the golf club head of the present invention.
Figure 6:
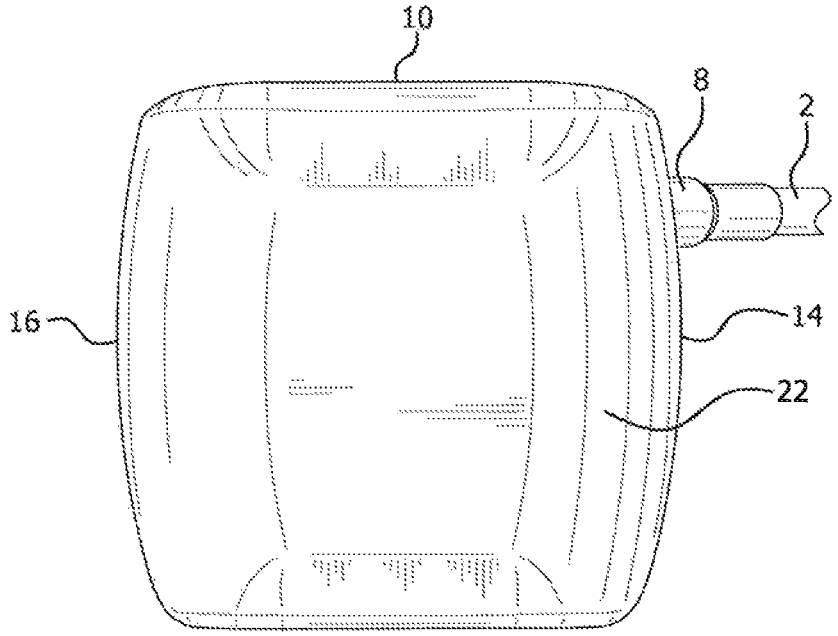
FIG. 6 is a bottom view of the golf club head of the present invention.
Figure 7:
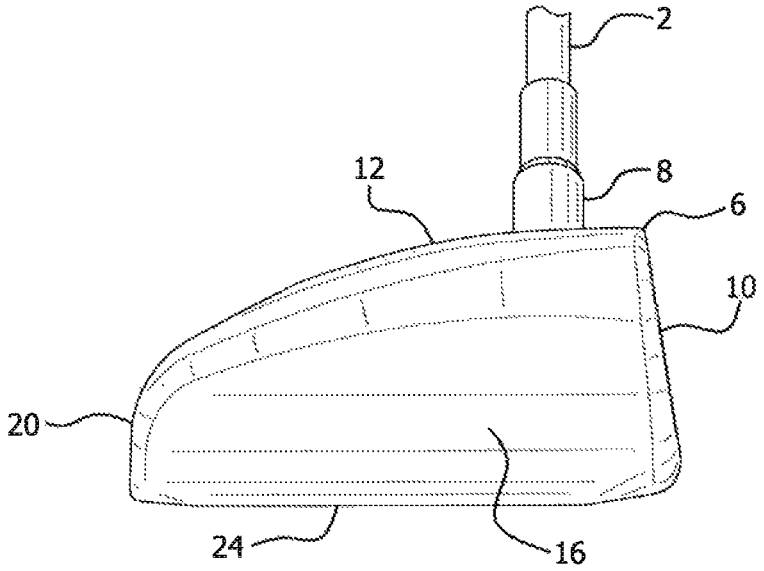
FIG. 7 is an elevation view of the golf club head of the present invention.
Figure 8:
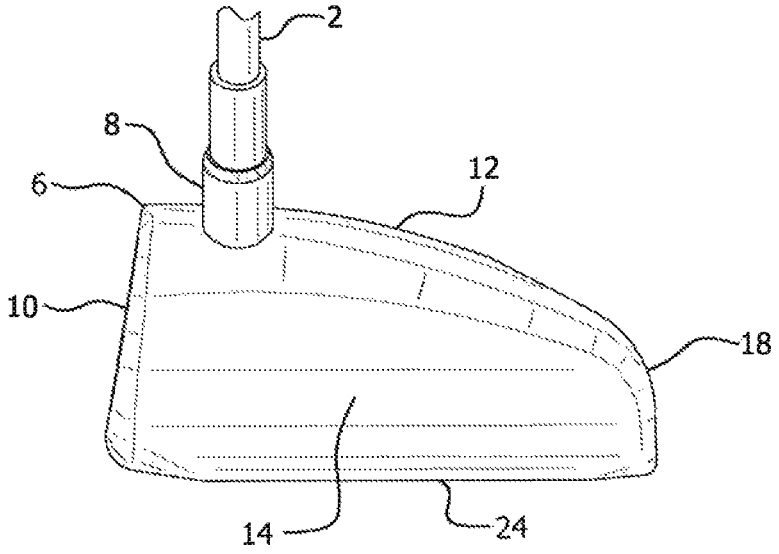
FIG. 8 is the opposite elevation view of the golf club head of the present invention.

Golf club 1 comprises shaft 2 with handle 4, connected to club head 6 via hosel 8. Club head 6 has a given width W and length L. See FIG. 5. Club head 6 further comprises club face 10, top wall 12 and sidewalls 14 and 16, smoothly curving down from the top wall. Top wall 12 slopes down the length of club head 6, from club face 10 at the front of the club head, to the back of the club head, forming lateral rear surfaces 18 and 20. These lateral rear surfaces extend down to bottom wall 22. Bottom wall 22, extending the width and length of club head 6, has substantially flat bottom surface 24 which also extends continuously the width and length and underneath the club head. Bottom wall 22 terminates at rear surface 26.

Figure 1:
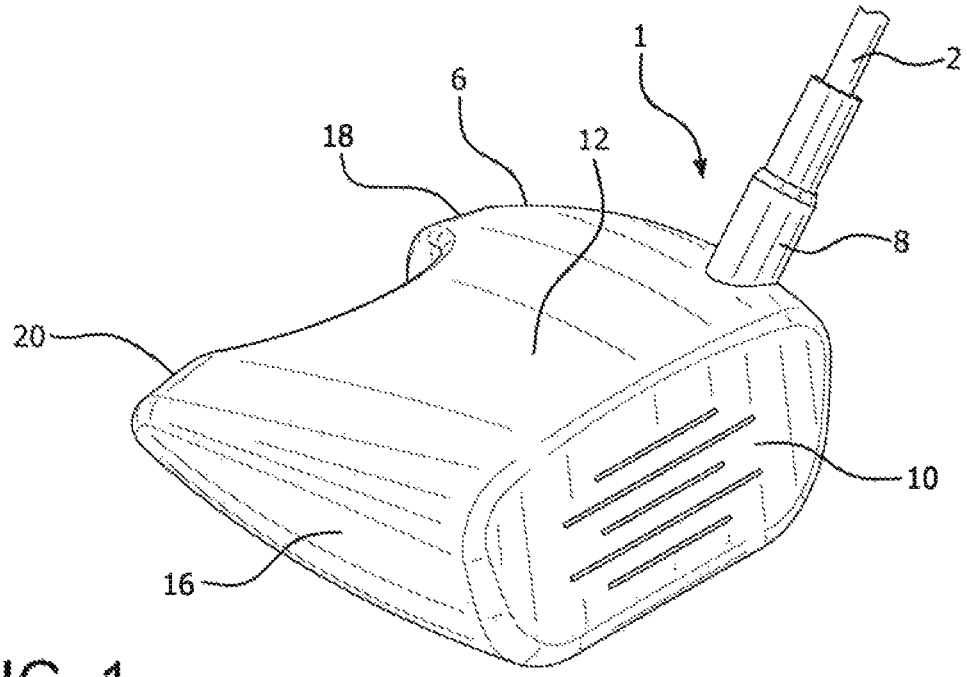
FIG. 1 is a perspective front view of the golf club head of the present invention.
Figure 2:
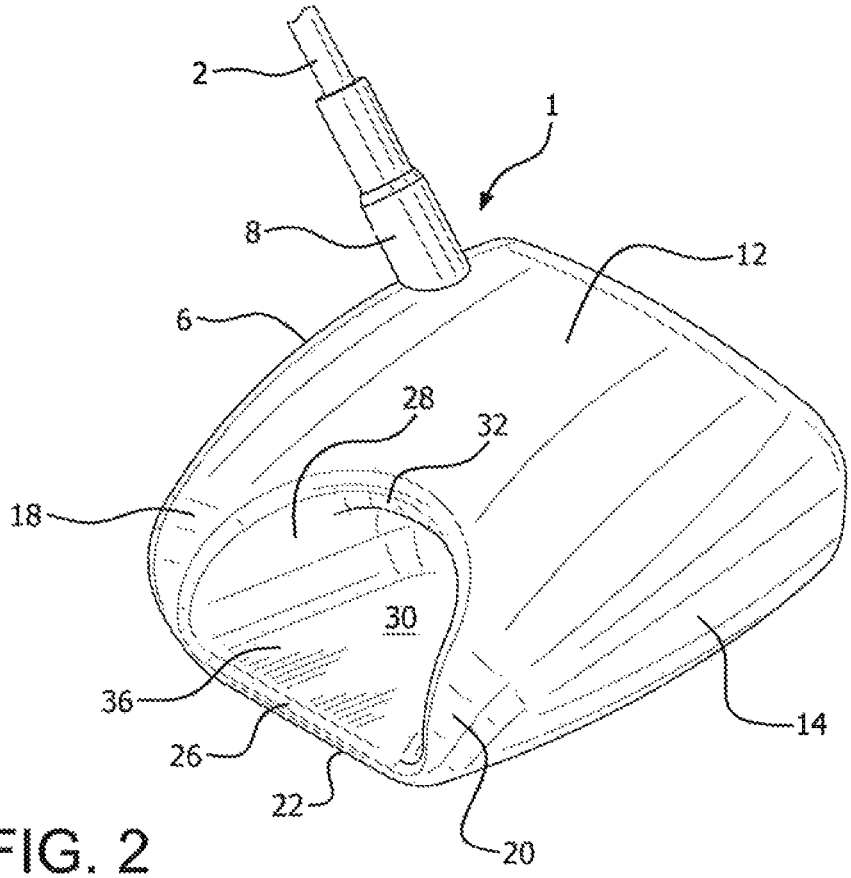
FIG. 2 is a rear perspective view of the golf club head of the present invention.
Figure 3:
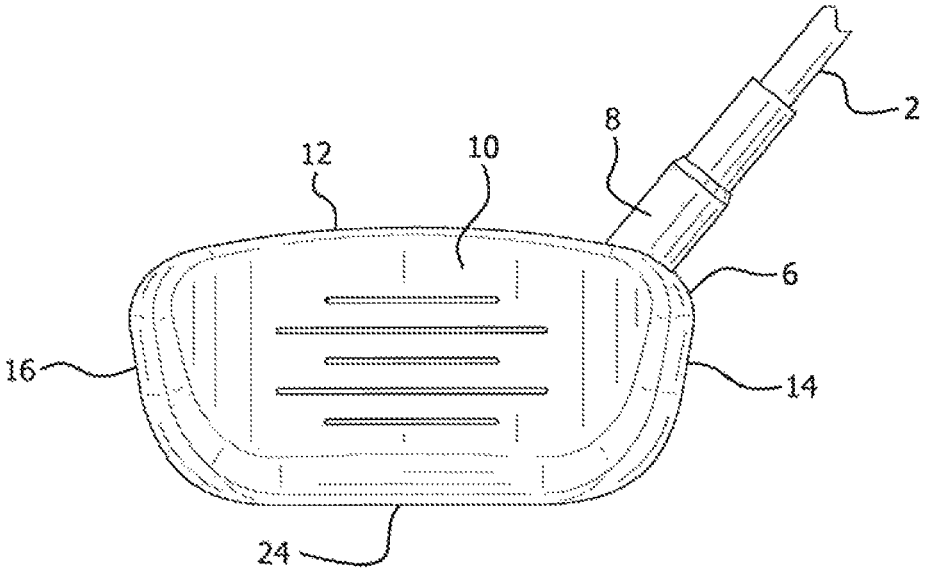
FIG. 3 is a front view of the golf club head of the present invention.
Figure 4:
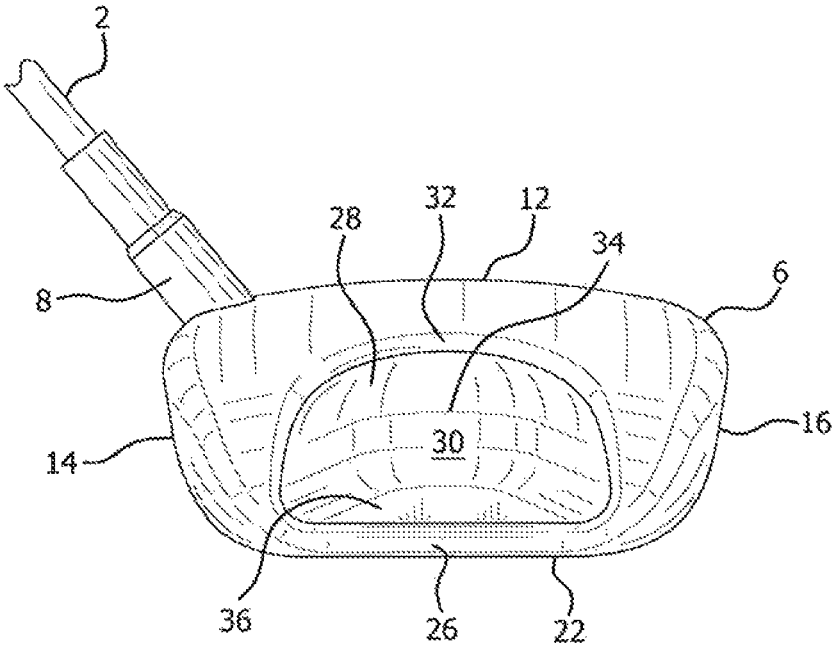
FIG. 4 is a rear view of the golf club head of the present invention.
Figure 9:
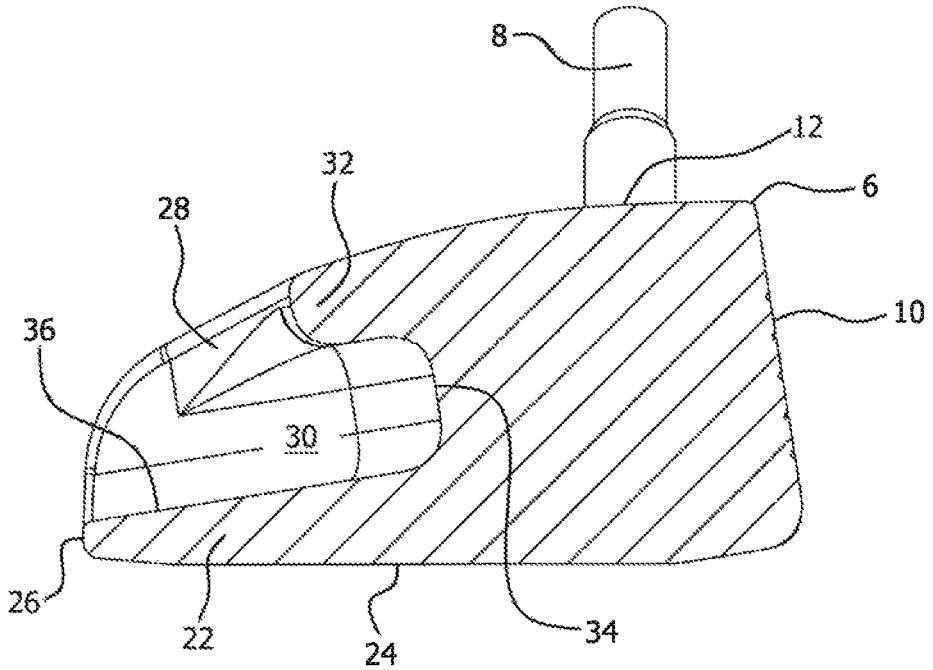
FIG. 9 is a cross-sectional view of the golf club head of the present invention taken from FIG. 5.

Cut-out cavity 28 extends inwardly, into club head 6, over bottom wall 22. Cavity 28 comprises open space 30, bordered by overhanging, curved upper lip section 32, curved back wall 34 defining the forwardmost or front part of the cavity, and substantially flat lower surface 36. Lower surface 36 slopes downwardly from back wall 34 to rear surface 26. The width of cavity 28 is generally tapered inwardly into club head 6, i.e. the cavity is widest at rear surface 26 at the back of the club head, and is narrowest at back wall 34, inset into the club head. Bottom wall 22 forms the closed bottom of cavity 28. See expecially, FIGS. 2, 5, and 9. By this configuration, cavity 28 is uniquely shaped to accommodate the front section of generic footwear, including a golf shoe, sneaker, tennis shoe, or the like 46. In fact, cavity 28 is specifically designed to accept the footwear of a fellow golfer, golf instructor, caddie, or other individual involved with the teaching or aiming function of golf club 1.

Golf club 1 is utilized as a most effective teaching tool as follows. Flat bottom surface 24 of bottom wall 22 of club head 6 is placed on ground surface 40, such that it rests flat on the ground surface. Club face 10 is properly aimed toward the target. In this position, golf club 1 is set such that its shaft 2 is at the correct golf shaft angle A in relation to ground surface 40.

Figure 10:
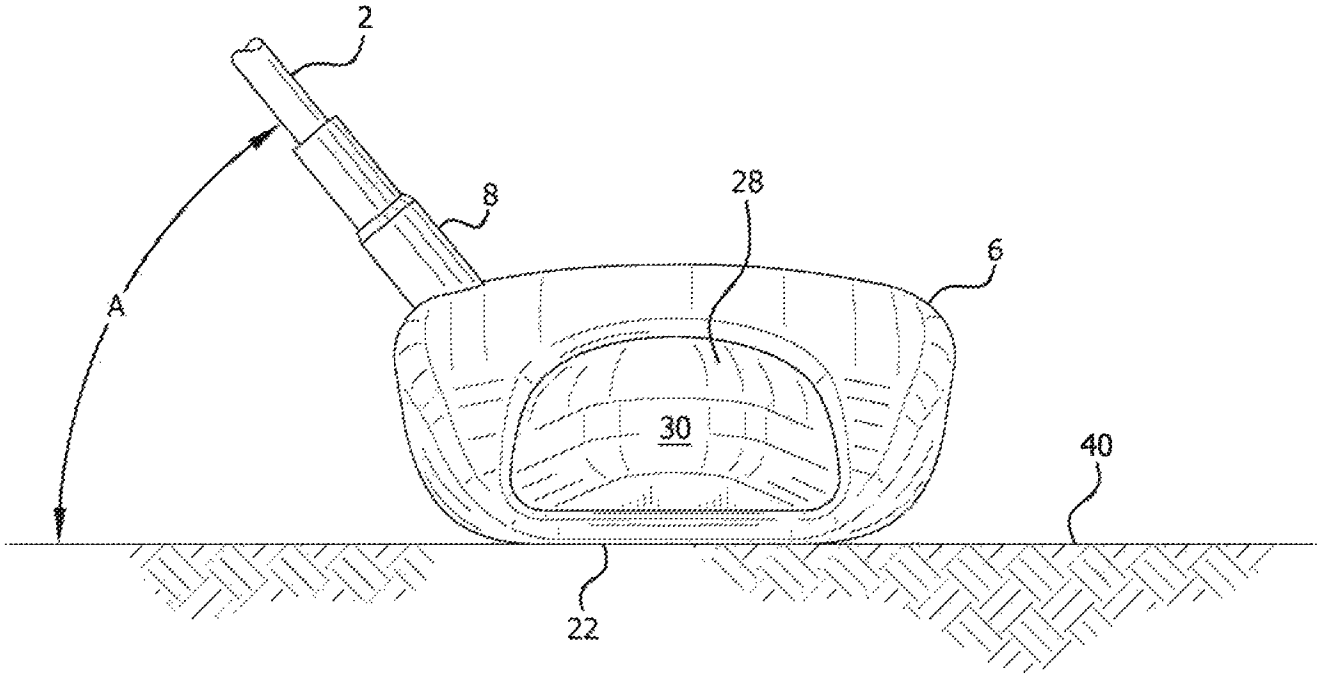
FIG. 10 is a view of the golf club head of the present invention in proper position of the ground surface.
Figure 11:
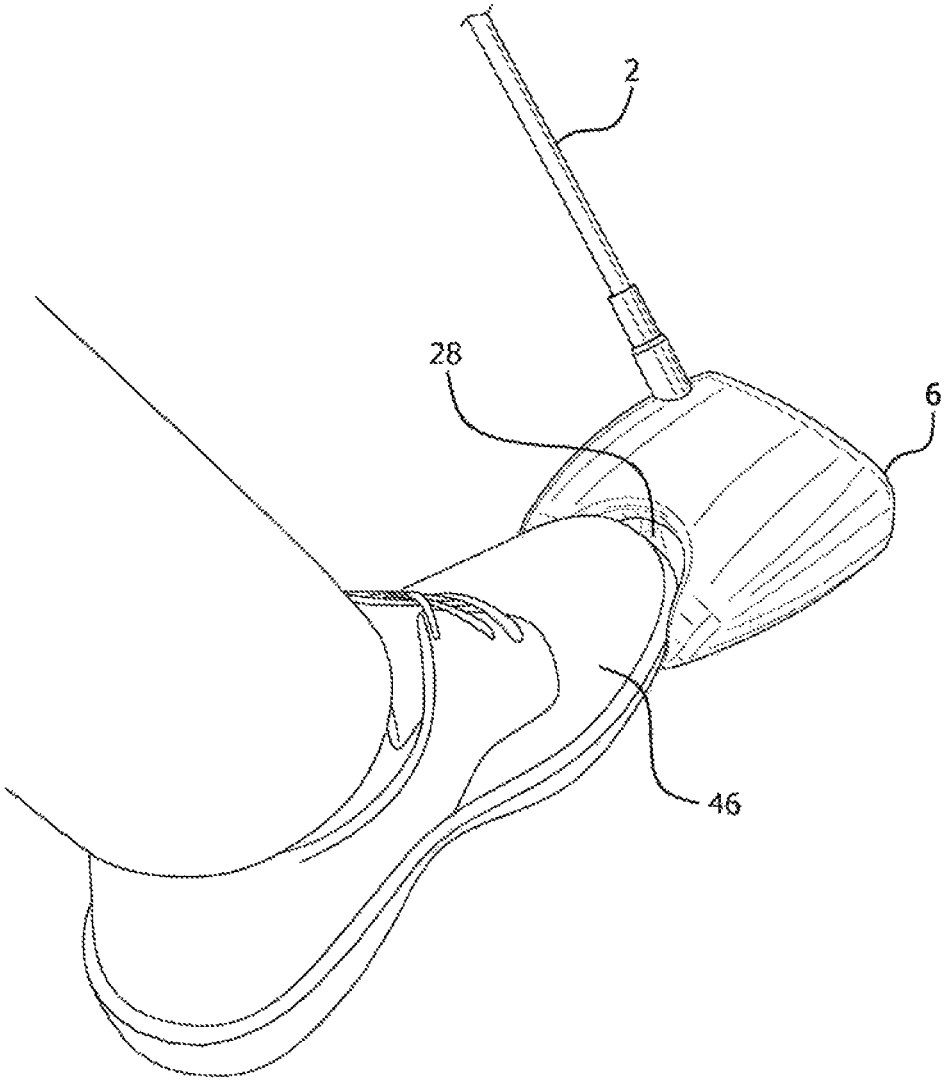
FIG. 11 is view of the manner in which the golf club head of the present invention is to be used.
Figure 12:
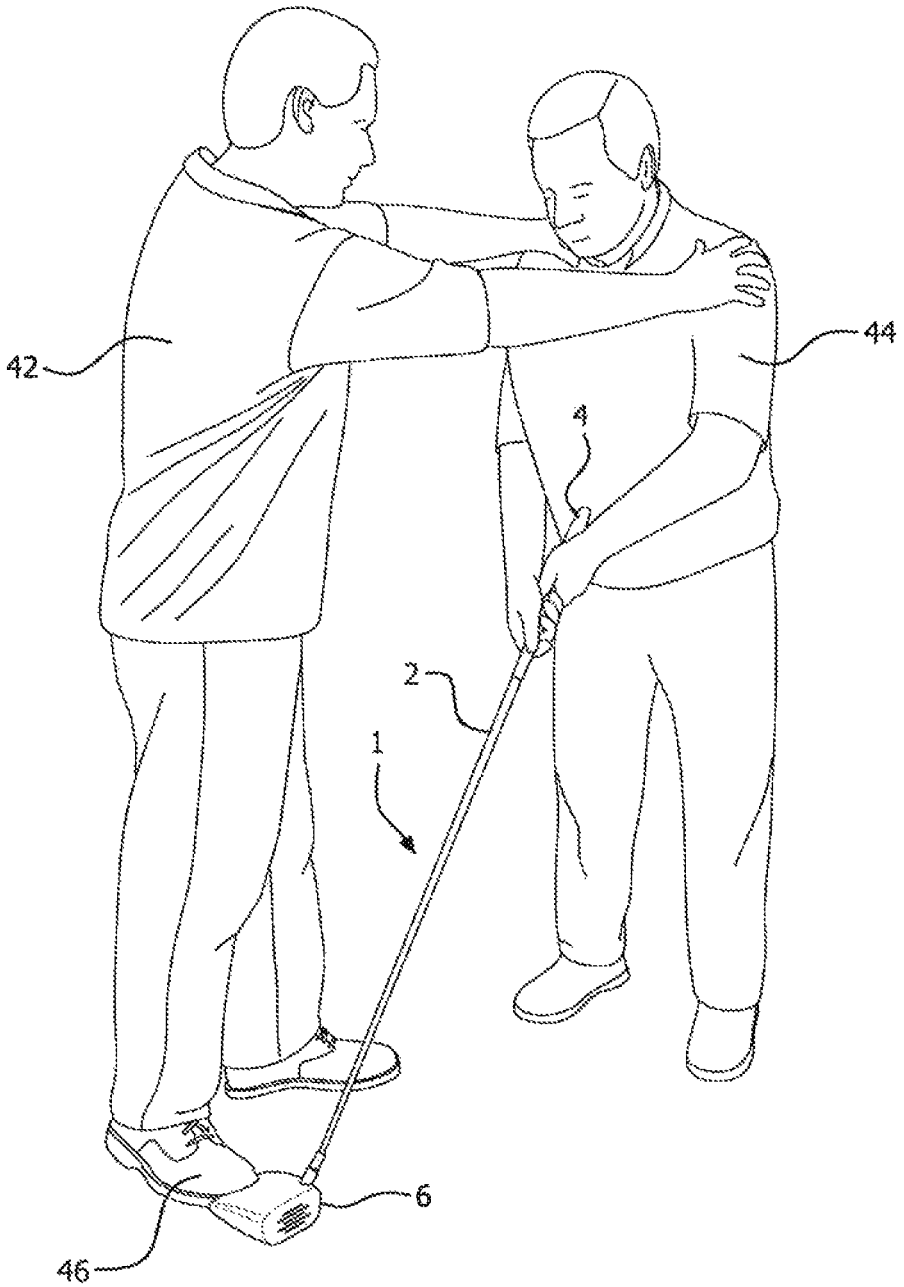
FIG. 12 is a representation of a golfing instructor and golfer using the golf club of the present invention.

Golf instructor 42, assisting golfer 44, positions himself such that he faces toward golf club 1 and steps into and inserts his foot, enclosed in footwear 46, into cavity 28 to maintain golf club 1 in a stationary position. See FIGS. 11 and 12. In so doing, the correct shaft angle A of club shaft 2, FIG. 10, is maintained, as golfer 42 grabs hold of handle 4 of the club. Club face 10 is also properly set towards the desired target. Instructor 42 can now maintain control of the position and angle of golf club 1, as he provides instruction to golfer 44. While his foot is within cavity 28, instructor 42 can also discuss with golfer 44 the proper positioning of his head, shoulders, arms, hands, hips, legs and feet, while the golfer is holding golf club 1 and the club is properly positioned and maintained at the correct shaft angle. With his footwear 46 within cavity 28, instructor 42 can also easily move toward golfer 44, to assist in manipulating the positions of his body to generally further advance the instruction process.

The use of golf club 1 in the process as described provides the optimum golf instructor/student training position for effectively teaching fundamental and advanced golfing techniques.

Golf club 1 can also be effectively utilized by the experienced golfer who wishes to ensure that his club is properly aimed at the desired target and set at the correct shaft angle. In this case, golf instructor, caddie, golfing partner or other individual 42 assisting golfer 44 steps into cavity 28, once golf club 1 is pre-aimed at the target. As with the teaching method, the correct shaft angle is thus again set as golfer 44 "steps into the golf shot" by grabbing hold of golf club 1 and setting himself in the proper position behind the club. The golfer's assistant 42 next removes his foot from cavity 28. Golfer 44 is now in position to swing golf club 1, properly aimed and set at the correct shaft angle, to produce the best possible shot.

Golf club 1, while advantageously employed in the teaching and pre-aiming methods described above, is, in and of itself, a club which will materially increase driving distance. Cavity 28 decreases the weight of club head 6, thus allowing the golfer to increase the speed of his back swing and down swing. In addition, the unique shapes of club head 6, with its tapered top wall 12, and the configuration of cavity 28 behind the club face within the club head, provides an aerodynamic design which dramatically increases the distance a golf ball travels upon impact.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A golf club head comprising:

a club face at a front of the club head;

a lateral rear surface at a back of the club head;

a top wall extending a length of the club head and sloping from the club face to the lateral rear surface;

a bottom wall extending the length of the club head, said bottom wall having a rear surface and a bottom surface, wherein the club face, lateral rear surface, top wall and bottom wall form a toe side and heel side, respectively, between the front and back of the club head; and a cut-out cavity comprising at least a portion of the top wall and at least a portion of the lateral rear surface and extending into the club head to a back wall defining a front of the cavity, said cavity being above the bottom wall and further comprising a lower surface sloping from said back wall, and having an upper curved lip section, overhanging the cavity, wherein the cavity is not visible at about a 90° angle from either the toe side of the club or the heel side of the club head, and wherein the cavity is adapted to substantially receive a foot of a user.

2. The golf club head as in claim 1 having a shaft extending from the top wall of the club head.

3. The golf club head as in claim 1 wherein the cavity extends from the back wall to the rear surface of the bottom wall.

4. The golf club head as in claim 1 where there are two lateral surfaces, one located on either side of the rear surface of the bottom wall.

5. The golf club head as in claim 1 wherein the cavity ends from the back wall to the rear surface of the bottom wall.

6. The golf club head as in claim 5 wherein there are two lateral surfaces, one lateral surface located on either side of the rear surface of the bottom wall.

7. The golf club head as in claim 1 wherein the curved lip section comprises at least a portion of the top wall extending over the cut-out cavity.

8. The golf club head as in claim 1 wherein the foot, when received by the club head, is able to contact the lower surface of the cavity.

9. The golf club head as in claim 1 wherein the back wall is curved.

10. The golf club head as in claim 1 wherein the back wall is over-arched.

11. A golf club head comprising:

a club face at a front of the club head;

a lateral rear surface at a back of the club head;

a top wall extending a length of the club head and sloping from the club face to the lateral rear surface;

a bottom wall extending the length of the club head, said bottom wall having a rear surface and a bottom surface, wherein the club face, lateral rear surface, top wall and bottom wall form a toe side and heel side, respectively, between the front and back of the club head; and a cut-out cavity comprising at least a portion of the top wall and at least a portion of the lateral rear surface and extending into the club head to a back wall defining a front of the cavity, said cavity being above the bottom wall and further comprising a lower surface sloping from said back wall, wherein at least a portion of the top wall extends over the cut-out cavity and wherein the cavity is not visible at about a 90° angle from either the toe side of the club or the heel side of the club head, and wherein the cavity is adapted to substantially receive a foot of a user.

* * * * *